United States Patent [19]

Warkentin

[11] 4,042,203

[45] Aug. 16, 1977

[54] EASEL

[76] Inventor: Verona D. Warkentin, 1776 Alta Vista, Sarasota, Fla. 33577

[21] Appl. No.: 620,331

[22] Filed: Oct. 7, 1975

[51] Int. Cl.[2] ..... A47B 97/04

[52] U.S. Cl. ..... 248/449; 248/463; 248/465

[58] Field of Search ..... 248/449, 460, 461, 462, 248/463, 464, 465, 451, 166, 432; 211/178 R; 40/125 H, 125 G, 125 N

[56] References Cited

U.S. PATENT DOCUMENTS

| | | | |
|---|---|---|---|
| 404,146 | 5/1889 | Ackerman | 248/465 |
| 2,032,872 | 3/1936 | Friedrichs | 248/449 |
| 2,526,527 | 10/1950 | Zander | 248/463 |
| 3,310,340 | 3/1967 | Brewer et al. | 297/16 |
| 3,368,786 | 2/1968 | Bulman | 248/465 |
| 3,738,606 | 6/1973 | Millen | 248/449 |
| 3,799,488 | 3/1974 | Sena | 248/460 |
| 3,847,335 | 11/1974 | Ross | 248/166 |
| D. 186,517 | 11/1959 | Walsh et al. | D6/145 |

FOREIGN PATENT DOCUMENTS

| | | | |
|---|---|---|---|
| 536,691 | 4/1955 | Belgium | 248/449 |
| 2,345 | 2/1908 | United Kingdom | 248/197 |

*Primary Examiner*—Robert A. Hafer
*Attorney, Agent, or Firm*—Robert F. Ruemeli

[57] ABSTRACT

A folding artist's easel, particularly suited for a classroom or teaching environment, utilizes square steel tubing to form a rigid triangular base, a supporting column, and a telescopic brace, with pivotal connections therebetween. The pivotal connections are substantially free of side play and along with connection of the supporting column to a mid-point of one side of the triangular base and connection of the brace to an apex opposite this side, superior stability is provided as well as a minimum required floor space to the rear of the easel, a feature which is particularly desirable in a classroom. A workpiece, such as a drawing board or canvas stretched on a frame, is securely and gently clamped to the easel by means of individually adjustable upper and lower steel cross-members which permit adjustment in the elevation of the workpiece as well as clamping a workpiece of great height. The top of the column is adapted to receive an extension for further increasing the effective height of the easel. Either or both of the adjustable cross-members may be provided with V-shaped parts for receiving the workpiece, thus firmly securing the workpiece against forward and rearward movement on the easel, or the lower cross-piece may have an upwardly opening channel for receiving the workpiece. The entire easel is preferably galvanized steel to assure a rust-free unit as well as increasing the weight of the easel. Galvanizing is particularly advantageous for the lower cross-member in that hardened paint which tends to collect on the lower cross-member may be scraped or otherwise removed therefrom without damaging the cross-member. When the easel is folded either or both the brace or the lower cross-member may be secured in place to retain the easel in its folded position, and the pivotal connection between the base and the brace interlocks with the column to prevent side movement between these parts.

21 Claims, 6 Drawing Figures

EASEL

This invention relates to easels and, more particularly, to a folding artist's easel.

BACKGROUND OF THE INVENTION

While the easel of this invention has features which make it particularly suitable as an artist's easel for classroom and teaching environments, it is also well suited for use as portable display stand because of the combination of sturdiness, steadiness, and lightness, along with ease of erecting and folding the easel and versatility in adjustment.

Prior art easels generally fall into one of two classes. Either they are extremely complex and therefore expensive to manufacture, and often complicated to adjust and to fold and erect; or they are basically unstable. Many prior easels permit inadequate adjustment and do not securely retain the workpiece. For example, the easels shown in the following U.S. Pat. Nos. 2,032,872; 2,526,527; 3,122,858; and 3,368,786; all have "T" bases in which the head and leg of the base are pivoted to each other to permit folding of the easel, and thus provide bases which are considerably less stable than a rigid integral base. Additionally, people who regularly use easels and therefore are familiar with various types, generally consider T bases of any type basically unstable. A massive easel with a rigid integral base is shown in U.S. Pat. No. 2,524,898, but this is not a folding easel and is of extremely complicated construction particularly so far as adjustment is concerned, and is apparently intended for holding a very heavy workpiece. For what they accomplish, all five of the previously noted easels are of a complicated construction requiring an excessive number of individual parts and with the possible exception of the easel shown in U.S. Pat. No. 2,524,898, appear to be basically unstable for normal use.

An old patent granted in 1889, U.S. Pat. No. 404,146, shows an easel with something approaching a triangular base, but without one leg of the triangle. The pivotal connections within the base, as well as the pivotal connections in the two front supports would result in a very unstable and unsteady easel after the parts have worn but a small amount. Additionally, no provision is made for securing a workpiece to the easel, but rather the workpiece simply rests on a pair of pins selectively received in holes in the front supports of the easel. A "Clothes Support" is shown in a U.S. Pat. No., Des. 186,517, granted in 1959, wherein a leg of a triangular base supports a column, the top of which supports a horizontal arm overlying the base, apparently for supporting clothes hangers. There is no indication in this design patent whether or not the clothes support is foldable, nor would this support be suitable for supporting a workpiece in the manner of a typical easel. While not believed to be particularly pertinent to the present invention, a "Work Holder" shown in U.S. Pat. No. 3,738,606, appears to be an adaptation of an adjustable camera support but having four instead of three telescopic legs with an adjustable connection between the leg unit and a workpiece supporting column, such adjustable connection being apparently unnecessary in a typical artist's easel. However, the patent does show a square supporting column telescopically receiving various clamping collars.

The easel of this invention incorporates substantially all of the desirable easel features of the prior art but in an easel of substantially simpler and less expensive design, and additionally incorporates highly desirable functional features not found in prior easels as well as an aesthetically pleasing configuration. Since the preferred embodiment of the present easel is constructed of steel with major portions of the easel being square steel tubes, the easel is extremely strong while being of relatively light weight, approximately 18 pounds, and foldable to a compact package so that it is relatively simple to carry and requires little storage space. Since the easel is galvanized steel, the galvanizing increases its weight slightly, and if a heavier easel is desired, the triangular base may be galvanized both inside and outside, or may be solid steel bars which also are preferably galvanized. In the environment of an artist's easel, the galvanized steel provides a surface which may be readily cleaned of hardened paints and other materials since the galvanized coating is relatively immune to deterioration from various solvents and may be scraped without appreciable damage.

While other configurations of bases may be provided, if desired, the triangular base is particularly stable and requires a very little floor space. The single supporting column of square steel tubing and the similar telescopic brace, and the sturdy substantially play-free pivotal connections between these parts combine to provide what is believed to be an extremely unique artist's easel. The cross-pieces which hold the workpiece are infinitely adjustable along the column to add to the versatility of the easel, and firmly clamp the workpiece in place. Inverted V-shaped parts on the upper cross-member snugly grip the top of the workpiece and secure it against forward and rearward movement. The easel is securely retained in its folded position without the use of special holding means and is compact and easy to handle when folded.

SUMMARY OF THE INVENTION

The invention, in brief, is directed to an artist's easel for adjustably supporting a workpiece, such as a drawing board or a canvas stretched on a frame, or the like. A rigid base provides a stable support for the easel and carries a supporting column and a brace for the column, the brace being adjustable for varying the attitude (inclination) of the column. A workpiece is clamped between a pair of cross-members which are infinitely adjustable along the column both toward and away from each other for holding various size workpieces, and also for positioning the workpiece at a desired elevation. A V-shaped workpiece receiver is provided on one of the cross-members for holding the workpiece against forward and rearward movement, as well as co-operating with the other cross-member in clamping the workpiece in place. Steel tubular construction of the base, column and brace, along with very sturdy pivotal connections, including a slide connection between the column and the brace, are substantially free of play to provide a very sturdy and stable easel which is relatively light in weight and may be conveniently folded into a compact package and secured in folded position without special fasteners or clamps. The easel is preferably galvanized, particularly a lower one of the cross-members, to facilitate relatively easy removal of paint hardened on the lower cross-member. An important commercial feature of the easel is that it may be constructed of standard, readily available materials, without the use of any appreciable machining or reshaping of the materials, for example, the steel tubing forming the telescopic brace and the clamping collars securing the cross-members to the supporting column.

It is a primary object of this invention to provide a new and useful support and, more particularly, a support in the form of an artist's easel.

Another object is provision of a new and useful easel which is both simple and economical in construction while being both sturdy and rugged.

Still another object is provision of a new and useful easel which is aesthetically pleasing in appearance.

A more specific object is provision of a new and useful easel including a rigid base, and column and brace members pivotally connected to each other for swinging movement about substantially parallel axes between an erect, operative position, and a folded position, and clamping members mounted on and adjustable lengthwise of the column for releasably clamping a generally rigid workpiece, such as a stretched canvas or a drawing board, for example, in desired position along the column. A related object is provision of such an easel in which the base is generally triangular and the column and the brace are secured to the base, one along the side of the base and the other proximate and apex of the base generally opposite the side and, more particularly, an equalaterial triangular base including three side members fixedly secured to one another at apexes of the base. Another related object is provision for mounting casters and/or facilitating securing the base to a supporting surface. A further related object is provision of a bifurcated part pivotally securing one of the members to the base, and in a folded position of the easel the bifurcated part embracing the other of the members to hold the members and the base against movement transversely of each other. A still further related object is provision of a first of the members in the form of a brace longitudinally adjustable for varying the attitude of the column, and for retaining the easel in its folded position, if desired. Another related object is provision of such an easel in which opposed receiving members on the column retain the workpiece therebetween, at least one of the receiving members having a generally V-shaped receiver opening toward the other receiving member for receiving the workpiece therein. Another related object is provision of the receiving members being adjustable toward and away from each other for clamping the workpiece therebetween and for varying the elevation of the workpiece. Still another related object is provision of a lower one of the receiving members being galvanized steel to facilitate removal of paint, or the like, therefrom. A further related object is provision of a first of the column and brace members having a track extending longitudinally thereof, a second of the members having a connecting portion slidably retained by said track for movement longitudinally of the first member, the first and second members being pivotally secured to each other by the connecting portion, and the workpiece retaining members having portions substantially encircling the first member with a gap receiving the connecting portion for movement of the retaining members longitudinally of the first member and past the connecting portion. A still further related object is the first member being the column, the track including a slot in the column, the second member being the brace and the connecting part being a slide received by the track, and the slide and brace being pivotally connected with each other.

Still another object is provision of an easel having base, column and brace members swingably connected one to the other for movement between operative and folded positions and including a bifurcated part secured to one of the members and embracing an end of a second of the members with the second member swingably connected with the bifurcated part, and when in the folded position the bifurcation of said part embracing a third of said members to hold said members against movement transversely of each other. A related object is provision of the bifurcated part operatively fixed to the base, the brace swingably connected with the bifurcated part and slidably connected with the column, and the bifurcation of the part embracing the column in the folded position of the easel.

A further object is provision of an easel for retaining a workpiece and including opposed receiving members for retaining the workpiece therebetween, and at least one of the receiving members having a generally V-shaped portion opening toward the other receiving member for receiving the workpiece therein. A related object is provision of the V-shaped portion including spaced apart V-shaped parts for receiving the workpiece. Still another related object is provision of the receiving members being adjustable toward and away from each other for clamping the workpiece between the members. A further related object is provision of at least a lower one of the receiving members being galvanized steel to facilitate removal of paint, or the like, therefrom.

Still another object is provision of a new and useful easel having a generally triangular base, a column swingably secured to the base generally midway along the side of the base, and a brace swingably secured to the column and to the base proximate an apex of the base opposite the side. A related object is provision of such an easel in which the brace is longitudinally adjustable for varying the inclination of the column. Still another related object is provision of such an easel in which the column includes a track extending longitudinally thereof, a connecting part retained by the track for movement longitudinally of the column and the brace being swingably secured to the connecting part. Another related object is provision of a member for retaining a workpiece in a desired position along the column, the retaining member having a portion substantially encircling the column with a gap receiving the connecting part for movement of the retaining member longitudinally of the column and past the connecting part.

These and other objects and advantages of the invention will be apparent from the following description and the accompanying drawing.

DESCRIPTION OF THE ILLUSTRATED EMBODIMENT

Figure 1:
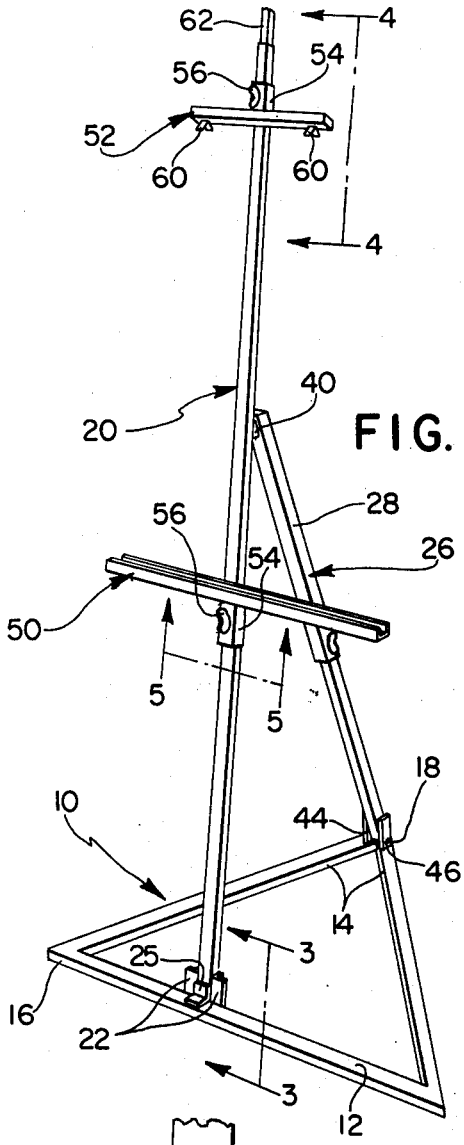
FIG. 1 is a schematic, perspective view of the easel in an erect, operative position.
Figure 3:
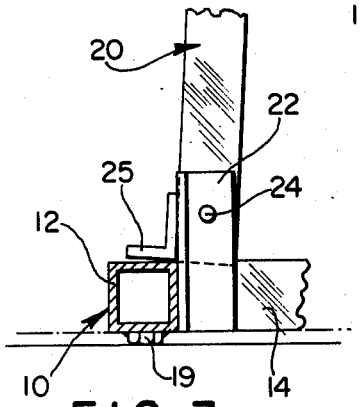
FIG. 3 is an enlarged, fragmentary sectional elevational view taken generally along the line 3—3 in FIG. 1.

Referring to FIG. 1 of the drawing, the easel has a generally equalateral triangular base 10 of 1¼ inch square steel tubing, and includes a front side 12 and rearwardly extending sides 14. The front side 12 is joined to the rearwardly extending sides 14 at apexes 16, the sides 14 being joined to each other at an apex 18. If desired, the bottom of face of the base 10 may be provided with suitable openings for receiving casters at each of the apexes 18, and these openings may be associated with depending nuts 19 so that either casters may be applied, or the base may be bolted to a suitable supporting surface. A column 20 is in the form of a rod and, more particularly, 1¼ inch square steel tubing, and is pivotally secured to the mid-point of the front side 12 by means of a pair of spaced apart steel angles 22 (FIG. 3) welded, or otherwise suitably fixed, to the rear face of the front side 12, with the column snugly held by the angles and pivoted thereto by means of a pivot pin 24. Opposed faces of the angles 22 snugly engage the bottom of the column 20 for effectively preventing side movement of the column. A generally L-shaped member 25 (FIG. 3) is welded or otherwise fixedly secured to the lower end of the column 20 to prevent the column from moving forwardly of a horizontal position, by engagement of a lower flange of the L-shaped member 25 with the top face of the triangular base side 12.

Figure 5:
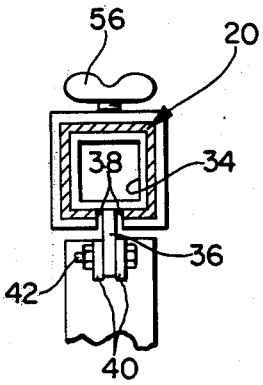
FIG. 5 is an enlarged, fragmentary sectional bottom view taken generally along the line 5—5 in FIG. 1.

A telescopically adjustable brace 26 is in the form of a telescopic rod and has an upper section 28 made from a piece of 1¼ inch square steel tubing and a lower section 30 made of 1 inch square steel tubing and snugly telescoped into the upper section 28, and adjustably secured in adjusted position by a wing bolt 32 threaded into a wall of the upper section 28 and clampingly engaging the lower section 30 in adjusted position of these parts. The upper telescopic section 28 of the brace 26 is pivotally secured to the column 20 by means of a connecting part in the form of a slide 34 (FIG. 5) formed of a short length of 1 inch steel tubing and snugly telescopically received within the column 20 for free sliding movement longitudinally of the column. A finger 36 is welded, or otherwise suitably fixed to the square tubular portion of the slide 34 and protrudes through a slot 38 extending longitudinally of the rear wall of the column 20. Along with the interior of the column 20, the slot 38 provides a track for the slide 34. A pair of spaced apart fingers 40 are welded, or otherwise fixedly secured, to the front face of the upper portion 28 of the brace 26 and closely embrace the finger 36, with a nut and bolt 42 extending through alined apertures in the finger 36 and the plates 40 and pivotally securing the brace 26 to the slide 34 for movement longitudinally of the column. The lower end of the brace section 30 is pivotally secured to the apex 18 of the base 10 by means of a bifurcated part 44 welded, or otherwise fixed, to the upper face of the base 10 and snugly engaging opposite sides of the lower brace section 30 with a pivot pin 46 pivotally securing the brace 26 in place on the part 44.

Cross-members for receiving a relatively rigid workpiece (not shown) such as a drawing board or a canvas stretched on a frame, include a lower cross-member 50 and an upper cross-member 52 slidably mounted on the column 20 for movement toward and away from each other and for positioning the workpiece at a desired elevation. Each of the cross-members 50 and 52 carry substantially identical collars 54 which are welded or otherwise fixedly secured thereto. Each collar 54 is telescopically received on the column 20 and is of square cross-section (FIG. 5), and is clamped in adjusted position on the column 20 by means of a wing bolt 56 threaded through the collar 54 and clampingly engaging the front face of the column 20. The lower cross-member 50 is channel-shaped with the channel opening upwardly toward the upper cross-member 52 for receiving the bottom edge portion of the workpiece. The upper cross-member carries a pair of depending, inverted V-shaped members 60 for receiving the upper edge portion of the workpiece. If desired, the lower cross-member 50 may be provided with upwardly facing V-shaped members, as 60, in lieu of the channel, and if desired, the upper cross-member 52 may be a downwardly opening channel member, in lieu of the V-shaped members 60. Thus, the workpiece is securely held in place between the channel and the V-members so that it cannot move forwardly or rearwardly, and is clamped in place between the cross-members 50 and 52 by the tightened collars 54. Infinite adjustment of the position of the workpiece is thus provided.

Figure 4:
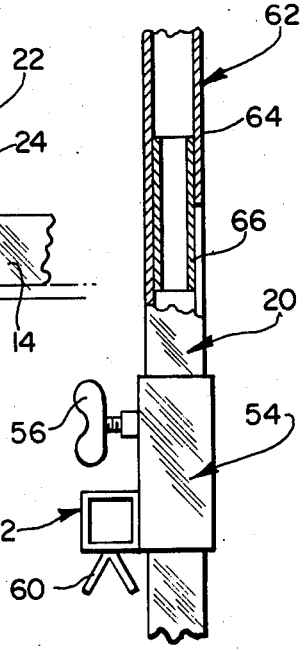
FIG. 4 is an enlarged, fragmentary elevational view taken generally along the line 4—4 in FIG. 1, with parts broken away and removed for clearer illustration.
Figure 6:
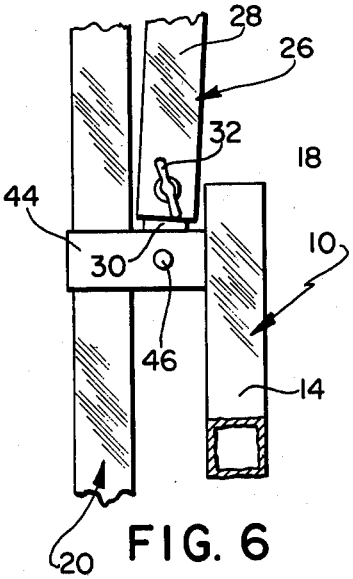
FIG. 6 is an enlarged, fragmentary sectional elevational view taken generally along the line 6—6 in FIG. 2.

If it is desired to handle larger workpieces in the members 50 and 52, or to support the piece at a higher elevation, a column extension 62 is provided (FIG. 4) and includes a 1¼ inch square steel tube 64 (the same size as the column 20) and a 1 inch square stub 66 telescoped into the tube 62 and fixed thereto in any suitable manner as by welding or by a bolt or rivet (not shown). The lower end of the stub 66 is snugly and removably telescoped within the open upper end of the column 20, so that the cross-membeer collars 54 can slide onto the extension 62.

Figure 2:
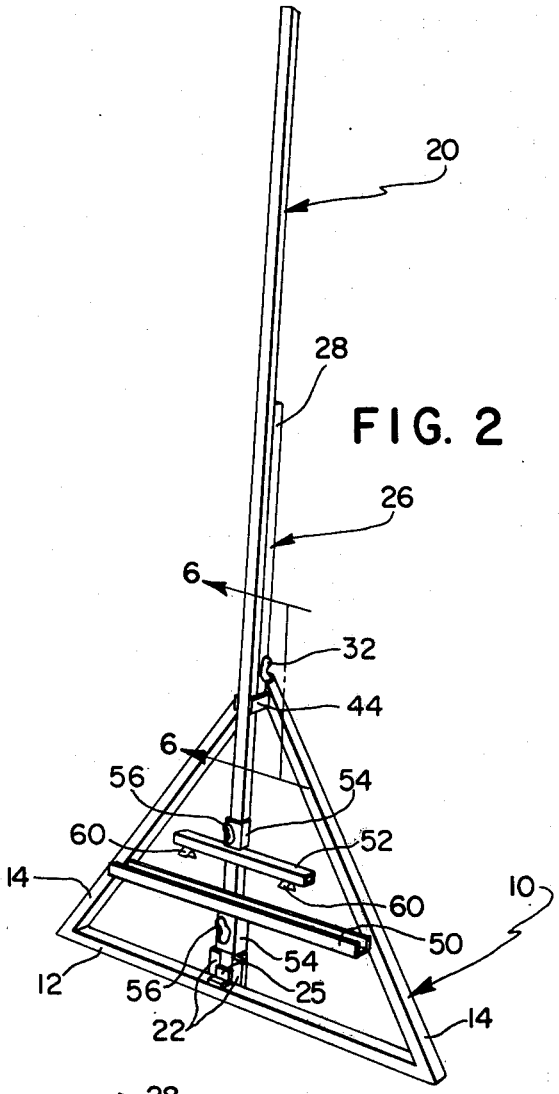
FIG. 2 is a schematic, perspective view of the easel in a folded position for carrying or storing the easel.

The easel may be conveniently folded, as shown in FIG. 2, for convenient storage and easy carrying of the easel. In folding the easel, the brace wing bolt 32 is first loosened and the brace 26 is telescoped into retracted position as the base 10 is swung upwardly about the pivot pin 24 (FIG. 3) which secures the column 20 to the base 10. The lower cross-member wing bolt 56 is then loosened and its collar 24 is telescoped downwardly on the column 20 until it rests on the upper edges of the angles 22 with the brace 26 and the base 10 nested against the column 20, whereupon the brace wing bolt 32 and the lower cross-member wing bolt 56 are tightened to firmly hold the easel in its folded position. When in the folded position, the lower cross-member 50 is within the outer faces of the base sides 14, and the upper cross-member 52 may be telescoped downwardly on the column 20 to rest against the top of the lower cross-member 50 whereupon the upper cross-member wing bolt 56 is tightened.

As the brace 26 and the base 10 are swung into folded position, the bifurcated member 44, secured to the upper face of the apex 18 of the base 10 engages the opposite side faces of the column 20 to prevent transverse movement of the column 20 and the brace 26 relative to each other and to the base 10.

The entire easel is preferably galvanized steel, in order to effectively prevent rusting of the steel and to provide an attractive appearance. Preferably, the steel tubing of the triangular base 10 is provided with holes in its underside so that after the apexes are welded to each other and polished, the entire base may be galvanized with the galvanizing coating the interior of the base tubes. It is particularly advantageous to galvanize the lower, steel cross-member 50, as this cross-member supports the bottom of the canvas and thus accumulates a great deal of paint which drops thereon and hardens. The galvanizing facilitates the scraping of the paint from the cross-member and tolerates many solvents which would damage other surfaces.

While this invention has been described and illustrated with reference to a particular embodiment in a particular environment, various changes may be apparent to one skilled in the art and the invention is therefore not to be limited to such embodiment or environment except as set forth in the appended claims.

What is claimed is:

1. An easel comprising, a base, and column and brace members, means pivotally securing said members to each other and each to spaced apart portions of said base for swinging movement about substantially parallel axes between an erect operative position and a folded position, the securing means including a bifurcated part secured to said base and embracing an end of a first of said members with the first member pivoted to said part for said swinging movement, and when in said folded position the base, column and brace are generally parallel to each other and the bifurcation of the part embraces the other of said members to hold said members against movement transversely of each other, and means for mounting a workpiece on the column.

2. An easel as set forth in claim 1 in which the first member is said brace and said brace is longitudinally adjustable for varying the attitude of said column and for retaining the easel in said folded position.

3. An easel as set forth in claim 1 in which said clamping means includes opposed receiving members for retaining said workpiece therebetween, at least a first of said receiving members having generally V-shaped means opening toward the other receiving member for receiving the workpiece therein, and said clamping means mounting said receiving members on said column for releasable adjustment toward and away from each other for clamping the workpiece between the members and varying the elevation of the workpiece.

4. An easel as set forth in claim 3 in which said V-shaped means comprises spaced apart V-shaped parts for receiving the workpiece.

5. An easel as set forth in claim 3 in which said other receiving member is a lower one of said receiving members and has a generally upwardly opening channel for receiving the workpiece therein.

6. An easel as set forth in claim 5 in which the lower receiving member is galvanized steel to facilitate removal of paint, or the like, therefrom.

7. An easel comprising, a base, and column and brace members, means pivotally securing said members to each other and each to spaced apart portions of said base for swinging movement about substantially parallel axes between an erect operative position and a folded position, a first of said members includes track means extending longitudinally thereof, a connecting portion retained by said track means for movement longitudinally of the first member, the securing means including said track means and said connecting portion, a second of said members connected to said connecting portion, and clamping means mounted on and adjustable lengthwise of said column for releasably clamping a workpiece in desired position along the column, said clamping means having a portion encircling said connecting portion for movement of the clamping means longitudinally of said first member and past said connection portion.

8. An easel as set forth in claim 7 in which the first member is said column, said track means includes a longitudinally extending slot in said column, the second member is said brace, said connecting portion is a slide, and said slide and said brace being pivotally connected with each other.

9. An easel comprising, a triangular base, and column and brace members, means pivotally securing said members to each other and each to spaced apart portions of said base for swinging movement about substantially parallel axes between an erect operative position and a folded position with the column member secured generally midway along a side of said base and the brace member secured at an apex of the base opposite said side, a first of said members including track means extending longitudinally thereof, a connecting portion retained by said track means for movement longitudinally of the first member, the securing means including said track means and said connecting portion, a second of said members connected to said connecting portion, and clamping means mounted on and adjustable lengthwise of said column for releasably clamping a workpiece in desired position along the column, said clamping means having a portion substantially encircling said first member with a gap receiving said connecting portion for movement of the clamping means longitudinally of said first member and past said connecting portion.

10. An easel as set forth in claim 9 in which the first member is said column, said track means includes a longitudinally extending slot in said column, the second member is said brace, said connecting portion is a slide received by said track, and said slide and said brace being pivotally connected with each other.

11. An easel as set forth in claim 10 in which one of said securing means including a bifurcated part and the associated member being pivoted to said part for said swinging movement and being received within the bifurcation thereof, and when in said folded position the members and base are generally parallel to each other and the bifurcated part embracing the other of said members to hold said members against movement traversely of each other.

12. An easel as set forth in claim 11 in which said associated member is said brace and said brace is longitudinally adjustable for varying the attitude of said column and for retaining the easel in said folded position.

13. An easel as set forth in claim 12 in which said clamping means includes opposed receiving members for retaining said workpiece therebetween, an upper one of said receiving members having generally V-shaped spaced apart parts opening toward the other receiving member, for receiving the workpiece therein, and a lower one of said receiving member has a generally upwardly opening channel for receiving the workpiece therein.

14. An easel as set forth in claim 13 in which at least the lower receiving member is galvanized steel to facilitate removal of paint, or the like, therefrom.

15. An easel comprising, a rigid base, and column and brace members, means pivotally securing said members to each other and each to spaced apart portions of said base for swinging movement about substantially parallel axes between an erect operative position and a folded position, the securing means includes a bifurcated part secured to said base and embracing an end of a first of said members with the first member pivoted to said part for said swinging movement, and when in said folded position the bifurcation of said part embracing a second of said members to hold said members against movement transversely of each other, one of said members includes track means extending longitudinally thereof, a connecting portion retained by said track means for movement longitudinally of said one of said members, said securing means including said track means and said connecting portion, the other of said members connected with said connecting portion, and clamping means mounted on and adjustable lengthwise of said column for releasably clamping a workpiece in desired position along the column, said clamping means having a portion substantially encircling said one of said members with a gap receiving said connecting portion for movement of the clamping means longitudinally of said first member and past said connecting portion.

16. An easel as set forth in claim 15 in which the first member is said brace, said brace is longitudinally adjustable for varying the attitude of said column and for retaining the easel in said folded position, the second member is said column, said track means includes a slot in said column, said connecting portion is a slide, and said slide and said brace are pivotally connected with each other.

17. An easel comprising, base, and column and brace members, securing means swingably connecting said base and said members one to the other between operative and folded positions and said means including a bifurcated part secured to said base and embracing an end of one of said members with the last said member swingably connected with said part, and when in the folded position the bifurcated part embracing the other of said members to hold said members against movement transversely of each other.

18. An easel as set forth in claim 17 in which said bifurcated part is operatively fixed to said base, said brace is swingably connected with said part and is slidably connected with said column, and the bifurcation of said part embraces said column in said folded position of the easel.

19. An easel as set forth in claim 18 in which said brace is longitudinally adjustable.

20. An easel comprising, a generally triangular base, a column swingably secured to said base generally midway along a side of said base, said column including track means extending longitudinally thereof, a connecting part retained by said track means for movement longitudinally of said column, a brace swingably secured to said column and to said base proximate an apex of the base opposite said side, said brace being longitudinally adjustable for varying the attitude of said column and being swingably secured to said part, and means for releasably retaining a workpiece in desired position along said column, the retaining means having a portion substantially encircling said column with a gap receiving said connecting part for movement of the retaining means longitudinally of said column and past said connecting part.

21. An easel as set forth in claim 20 in which said column and said brace are each unitary rod lengths.

* * * * *